US007536841B2

(12) United States Patent
Tallier

(10) Patent No.: US 7,536,841 B2
(45) Date of Patent: May 26, 2009

(54) METHOD AND APPARATUS FOR MAKING HINGE-LID PACKS OF CIGARETTES

(75) Inventor: Bernard Tallier, Cortaillod (CH)

(73) Assignee: Philip Morris USA Inc., Richmond, VA (US)

( * ) Notice: Subject to any disclaimer, the term of this patent is extended or adjusted under 35 U.S.C. 154(b) by 494 days.

(21) Appl. No.: 11/245,434

(22) Filed: Oct. 7, 2005

(65) Prior Publication Data

US 2006/0117715 A1 Jun. 8, 2006

(30) Foreign Application Priority Data

Oct. 7, 2004 (EP) ..... 04256211

(51) Int. Cl.
*B65B 11/00* (2006.01)
*B65B 19/34* (2006.01)
*B65B 49/00* (2006.01)

(52) U.S. Cl. ..... 53/464; 53/444; 53/135.1; 53/234

(58) Field of Classification Search ..... 53/444, 53/464, 128.1, 135.1, 236, 228, 232, 233, 53/234

See application file for complete search history.

(56) References Cited

U.S. PATENT DOCUMENTS 3,317,033 A * 5/1967 Chalmers ..... 206/268
4,084,393 A * 4/1978 Focke ..... 53/136.4
4,258,528 A * 3/1981 Focke ..... 53/473
4,308,708 A * 1/1982 Focke ..... 53/136.4
4,526,317 A * 7/1985 Cassidy ..... 229/146
4,559,758 A * 12/1985 Gamberini ..... 53/207
4,596,112 A * 6/1986 Buckley et al. ..... 53/476
4,612,756 A * 9/1986 Focke et al. ..... 53/579

(Continued)

FOREIGN PATENT DOCUMENTS

DE 3819874 A1 1/1989

(Continued)

OTHER PUBLICATIONS

European Search Report dated Mar. 16, 2005.

*Primary Examiner*—Paul R Durand
(74) *Attorney, Agent, or Firm*—Buchanan Ingersoll & Rooney PC

(57) ABSTRACT

A method for making a hinge-lid pack of cigarettes, which finds particular application in the manufacture of a pack with rounded or beveled vertical edges having retention means to facilitate consistent lid closure, comprises: positioning an inner frame on a bundle of cigarettes; folding a first end of a blank for a hinge-lid cigarette pack over one end of the bundle of cigarettes to at least partially form the lid of the pack; and moving the inner frame relative to the blank in the direction of the at least partially formed lid. Apparatus for making a hinge-lid pack of cigarettes by folding a blank for a hinge-lid cigarette pack about a bundle of cigarettes having an inner frame thereon, includes means for forming a portion of the blank into the lid of the pack, the apparatus further comprises means for moving the inner frame relative to the blank towards the at least partially formed lid. Preferably, the apparatus comprises a wheel indexable between a number of stations, the wheel having a plurality of pockets spaced about its periphery.

4 Claims, 2 Drawing Sheets

U.S. PATENT DOCUMENTS

| | | | | | |
|---|---|---|---|---|---|
| 4,938,005 | A * | 7/1990 | Focke | 53/410 |
| 4,979,349 | A * | 12/1990 | Focke | 53/234 |
| 5,168,690 | A * | 12/1992 | Quadrana | 53/575 |
| 5,228,266 | A * | 7/1993 | Focke | 53/383.1 |
| 6,000,196 | A * | 12/1999 | Boldrini et al. | 53/410 |
| 6,439,239 | B1 * | 8/2002 | Spatafora et al. | 131/58 |
| 6,612,094 | B1 * | 9/2003 | Bailey et al. | 53/234 |
| 6,694,708 | B2 * | 2/2004 | Brizzi et al. | 53/462 |
| 6,854,243 | B2 * | 2/2005 | Sendo et al. | 53/234 |
| 7,155,882 | B2 * | 1/2007 | Ghini et al. | 53/444 |

FOREIGN PATENT DOCUMENTS

| | | |
|---|---|---|
| EP | 0434962 B1 | 11/1990 |
| WO | WO 02/02306 A | 1/2002 |

* cited by examiner

METHOD AND APPARATUS FOR MAKING HINGE-LID PACKS OF CIGARETTES

This application claims priority under 35 USC §119 to European Patent Application No. 04256211.6, filed on Oct. 7, 2004 which is incorporated by reference herein.

The present invention relates to a method and an apparatus for making hinge-lid packs of cigarettes and finds particular application in the manufacture of hinge-lid cigarette packs with rounded or bevelled vertical edges having retention means to facilitate consistent lid closure.

Cigarettes are commonly sold in hinge-lid packs having a lower box portion and an upper lid portion that is hinged to the rear wall of the box portion. The front of the lid is pivoted up and to the rear by the consumer to open the pack and thereby allow access to a foil wrapped bundle of cigarettes standing in the box. When the lid is closed, the front, side and rear walls of the lid are vertical extensions of the corresponding walls of the box. Most known hinge-lid cigarette packs have right-angled vertical edges, but hinge-lid cigarette packs having rounded or bevelled vertical edges, formed by scoring the laminar blank that is folded to produce the pack, are also known.

Conventional hinge-lid cigarette packs typically also include an inner frame or collar inside the front and sides of the box portion, at least a portion of the inner frame extending above the box into the space covered by the lid in the closed position. A central cut-out is provided in the front wall of the inner frame to allow the consumer to remove cigarettes from the pack in the open position. As well as reinforcing the front and sides of the pack, the inner frame provides some interference or frictional engagement with the lid as it opens and closes, thereby helping to prevent accidental opening of the pack and to retain the lid in the closed position when desired.

It is desirable for the bottom edges of the lid to rest directly on the top edges of the lower box portion when in the closed position. For the most part, however, in conventional hinge-lid packs the inner frame provides interference with the lid only once it has opened beyond a certain point. Consequently a known problem associated with conventional hinge-lid cigarette packs is that after repeated opening and closing of the pack the lid does not revert to the desired completely closed position, but remains slightly open with a small gap between the lid and the box portion of the pack.

To address the problem of incomplete lid closure, it is known to produce hinge-lid cigarette packs having retention means on the inner frame and/or lid which provide additional interference between the outer surface of the inner frame and the inner surface of the lid and/or which interlock, in order to substantially prevent the lid from inadvertently opening to any degree. For example, in hinge-lid cigarette packs having right-angled vertical edges it is known to provide a pair of tabs that extend substantially perpendicular to the plane of the side walls of the inner frame along the front right-angled vertical edges thereof. These tabs provide increased friction between the inner frame and the lid as it is opened and closed and thereby help retain the lid in a completely closed position.

For hinge-lid cigarette packs having rounded or bevelled vertical edges, where the formation of tabs along the correspondingly rounded or bevelled vertical edges of the inner frame may be difficult or impossible, alternative retention means have been proposed. For example, EP-A-0 434 962 discloses a hinge-lid cigarette pack with rounded vertical edges having a lid inner flap folded against the inside of the lid front wall, the side edges of which are provided with opposed recesses so as to define a pair of holding tabs. In use, upon closure of the lid, the upper region of the lateral portions of the front wall of the inner frame of the pack, on either side of the central cut-out section, enter the recesses in the inner lid flap and slide under the holding tabs. The wedging of the inner frame between the inner lid flap and the lid front wall upon closure of the lid provides increased frictional resistance that helps to retain the lid in a completely closed position.

Typically in the production of hinge-lid cigarettes packs a bundle of cigarettes pre-wrapped in, for example, metallised paper or aluminium foil is placed together with an inner frame in a pocket lined with a laminar card blank on an indexing wrapping wheel. As the pocket indexes around from station to station, the blank is folded in stages around the pre-wrapped bundle of cigarettes and inner frame to form the pack. To ensure that "lid-locks" such as those discussed above function correctly when the hinge-lid pack is first opened and closed by the consumer, it is desirable for the retention means provided on the inner frame and/or lid to be brought into correct engagement with one another during production.

WO-A-02/02306 discloses a method and apparatus for producing hinge-lid cigarette packs of the type disclosed in EP-A-0 434 962 in which the laminar blank is initially partially folded around a bundle of cigarettes and inner frame on a folding turret mounted for rotation about a vertical axis, so that the lid inner flap rests on top of the inner frame. To wedge the upper region of the lateral portions of the inner frame of the pack between the holding tabs of the inner lid flap and the lid front wall, the partially formed pack is then ejected radially from the folding turret and transported longitudinally along a conveyor path where the partly formed lid is partially opened and then closed again before production of the pack is completed.

While the method and device disclosed in WO-A-02/02306 brings the inner frame and inner lid flap of the hinge-lid pack into engagement during production, thereby actuating the lid-lock, the partially formed pack and bundle of cigarettes therein is moved longitudinally in order to partially open and re-close the lid. In other known apparatus for producing hinge-lid packs, such as the packers sold under model numbers X2 and X3 by G.D S.p.A. of Bologna, Italy, folding of the laminar blank around the pre-wrapped bundle of cigarettes and inner frame to form the pack is completed on an indexing wrapping wheel mounted for rotation about a horizontal axis and there is no longitudinal movement of the pre-wrapped bundle of cigarettes during folding of the blank. For the reasons already discussed above, it is also desirable for retention means provided on the inner frame and/or lid of a hinge-lid pack to be brought into correct engagement with one another during production using such latter known apparatus.

SUMMARY

According to the invention there is provided a method for making a hinge-lid pack of cigarettes comprising: positioning an inner frame on a bundle of cigarettes; folding a first end of a blank for a hinge-lid cigarette pack over one end of the bundle of cigarettes to at least partially form the lid of the pack; and moving the inner frame relative to the blank in the direction of the at least partially formed lid.

According to the invention there is also provided apparatus for making a hinge-lid pack of cigarettes by folding a blank for a hinge-lid cigarette pack about a bundle of cigarettes having an inner frame thereon, the apparatus including means for forming a portion of the blank into the lid of the pack, the apparatus further comprising means for moving the inner frame relative to the blank towards the at least partially formed lid.

Preferably, the apparatus comprises: a wheel indexable between a number of stations, the wheel having a plurality of pockets spaced about its periphery; a first station at which a blank for a hinge-lid cigarette pack is introduced into a pocket on the wheel; a second station at which a bundle of cigarettes having an inner frame thereon is introduced into the pocket; a third station at which a first end of the blank is folded over one end of the bundle of cigarettes so as to at least partially form the lid of the pack; and a station at which the inner frame is moved relative to the blank in the direction of the at least partially formed lid.

The inner frame may be moved relative to the blank by a mechanically, pneumatically and/or electrically driven device, for example by an electrical device driven by a linear motor or servo motor. Preferably, the inner frame is moved by a reciprocating or oscillating pusher rod which, in use, engages the inner frame to move it. Other means of moving the inner frame relative to the blank, such as, for example, an angled guide rail or bar mounted about the periphery of the indexing wheel above the pockets may also be employed.

By moving the inner frame relative to the blank, the method and apparatus of the invention allow retention means provided on the lid and/or inner frame of a hinge-lid pack to be brought into engagement during production of the pack. Furthermore, in order to engage the retention means the method and apparatus of the invention does not require the lid of the hinge-lid pack to be partially opened and re-closed and/or the bundle of cigarettes to be moved longitudinally during production. Consequently, existing known apparatus for producing hinge-lid cigarette packs in which the pack is completed by folding a blank around a bundle of cigarettes and inner frame on an indexing wrapping wheel mounted for rotation about a horizontal axis can be modified readily to carry out the method of the invention.

BRIEF DESCRIPTION OF FIGURES

The invention will be further described by way of example only with reference to the accompanying drawings in which.

DETAILED DESCRIPTION

Figure 1:
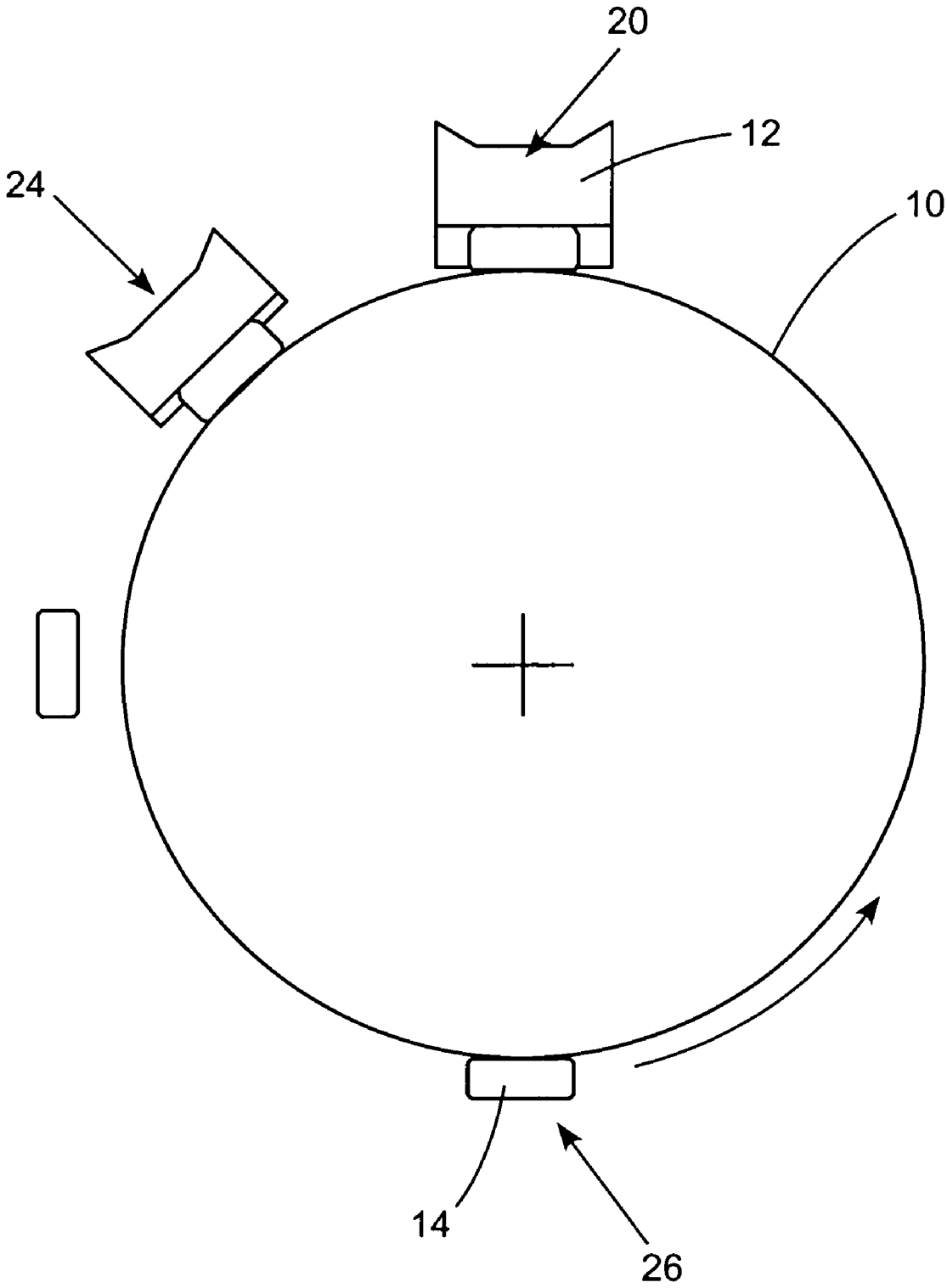
FIG. 1 is a schematic front view of apparatus according to the invention for making a hinge-lid cigarette pack from a blank and inner frame of the type shown in FIGS. 4 and 5 of EP-A-0 434 962.

The apparatus according to the invention shown schematically in FIG. 1 is of similar overall construction to the known hinge-lid packer sold under model numbers X2 and X3 by G.D S.p.A. of Bologna, Italy and comprises a folding wheel 10 mounted for anti-clockwise rotation (shown by the arrow in FIG. 1) about a horizontal axis. A plurality of pockets (not shown) of substantially the same cross-section as the pack to be made are equally spaced around the circumference of the folding wheel 10 with their longitudinal axes parallel to the axis of rotation of the folding wheel 10. Known folding mechanisms for folding card blanks 12 around bundles 14 of cigarettes and inner frames 16 held in the pockets are fixed relative to the folding wheel 10 at and between a number of folding stations around the periphery of the folding wheel 10.

In the known hinge-lid pack making machines sold under model numbers X2 and X3 by G.D S.p.A. a pair of mechanical levers are pivotally mounted on either side of the folding wheel at a folding station located at the top thereof, together with a folding bar. In use, as the folding wheel indexes a pocket containing a card blank, bundle of cigarettes and inner frame through this upper folding station, one end of the card blank is folded over the end of the bundle of cigarettes and inner frame by one lever to partly form the lid of the hinge-lid pack, while the other end of the card blank is folded over the opposite end of the bundle of cigarettes and inner frame by the other lever and folding bar to form the lower portion of the front wall of the hinge-lid pack.

In the apparatus shown in FIG. 1, a first mechanical lever or other mechanically, pneumatically or electrically actuated folding mechanism for folding one end 18 of a card blank 12 over one end of a bundle 14 of cigarettes to partly form the lid of the hinge-lid pack, is mounted at a first folding station 20 at the top of the folding wheel 10. A second mechanical lever or other folding mechanism for folding the other end 22 of the card blank 12 over the opposite end of the bundle 14 of cigarettes to form the lower portion of the front wall of the hinge-lid pack is mounted at a second folding station 24 located downstream of the first folding station 20. In addition, a reciprocating pusher rod is mounted at the first folding station 20, on the opposite side of the folding wheel 10 to the first lever, for longitudinal movement relative to the pockets. The other stations positioned around the folding wheel 10 of the apparatus according to the invention shown in FIG. 1 are substantially the same as those of the known hinge-lid pack making machines sold by G.D S.p.A.

Figure 2A:
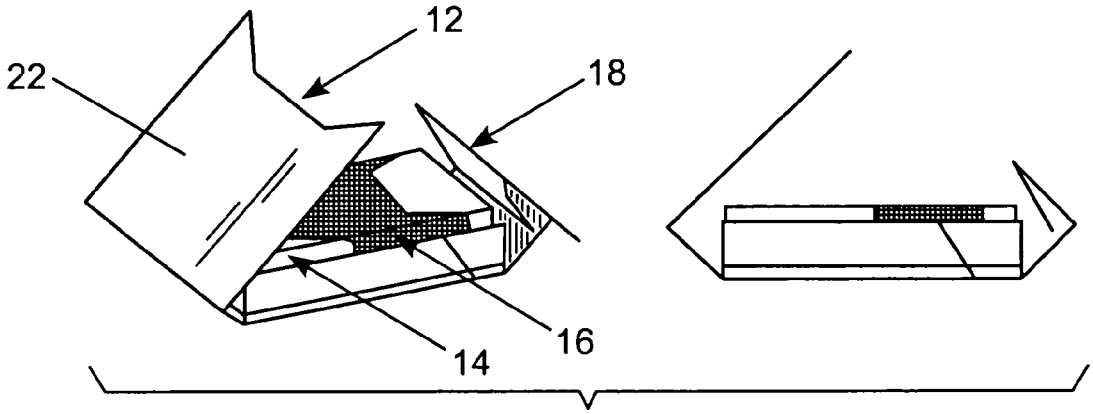
FIGS. 2*a* to 2*d* are schematic perspective views and side elevations of the blank and inner frame of a hinge-lid cigarette pack made using the apparatus of FIG. 1 at various stages during production.

In use, for the production of a round vertical edged pack of the type shown in EP-A-0 434 962, a bundle 14 of cigarettes wrapped in, for example, metallised or waxed paper or a polymeric film is prepared and supplied in a conventional manner to a first wheel (not shown) mounted for rotation about a vertical axis, which feeds the bundle 14 of cigarettes through a first loading station where it is placed in a known manner on top of an inner frame 16 of the type shown in FIG. 5 of EP-A-0 434 962. The bundle 14 and inner frame 16 are then transferred by further rotation of the first wheel to a second loading station 26 at the base of the folding wheel 10, where a vertical pusher pushes the bundle 14 and inner frame 16 upwards radially into a pocket on the folding wheel 10 containing a card blank 12 of the type shown in FIG. 4 of EP-A-0 434 962. The card blank 12 is inserted into the pocket in a known manner at another station (not shown) on the folding wheel 10 located upstream of the second loading station 26. The relative arrangement of the blank 12, bundle 14 of cigarettes and inner frame 16 in the pocket is shown in FIG. 2*a*. Prior to insertion of the blank into the pocket on the folding wheel 10, the holding tabs of the blank 12 are bent upwards, in a known manner, to facilitate interaction with the inner frame 16.

Figure 2B:
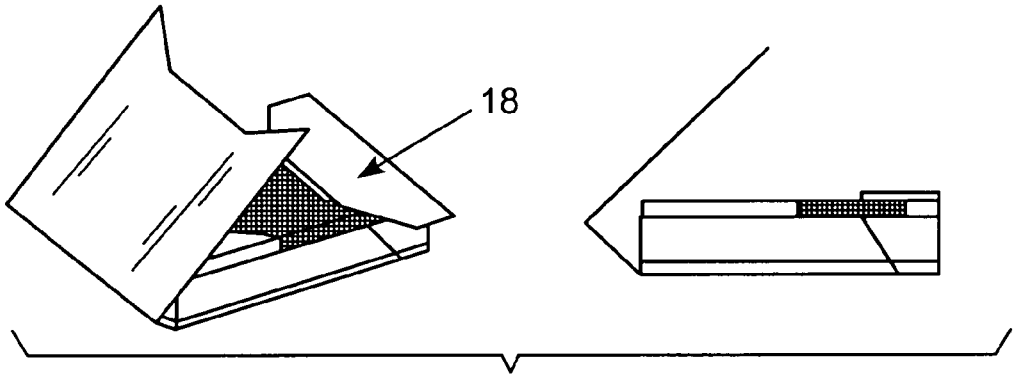

The folding wheel 10 indexes the pocket containing the card blank 12, bundle 14 of cigarettes and inner frame 16 anti-clockwise through the first folding station 20 where the first lever folds one end 18 of the card blank 12 over the end of the bundle 14 and inner frame 16 to partly form the lid of the hinge-lid pack, in the same manner as in the prior art apparatus, as shown in FIG. 2*b*. The initial position of the inner frame 16 relative to the bundle 14 in the pocket is such that as the card blank 12 is folded at the first folding station 20 by the first lever to partly form the lid, the opposed recesses and holding tabs of the inner lid flap of the blank 12 are not in contact with the upper region of the lateral portions of the inner frame 16.

Figure 2C:
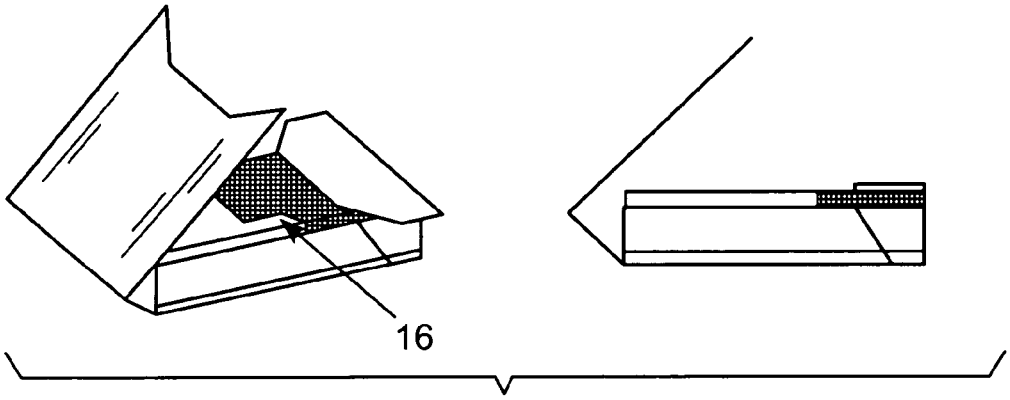

While the pocket is at the first folding station 20, the pusher rod moves relative to the pocket on the folding wheel 10 towards the partly formed lid. The pusher rod or finger may be moved in a rotary or linear fashion using the motion of the folding wheel 10 or a separate sequenced device in a manner well known in the art. The relative positions of the pusher rod and the pocket are such that as the pusher rod moves it pushes against the end of the inner frame 16 distant from the first lever, thereby moving the inner frame 16 longitudinally relative to the bundle 14 of cigarettes towards the partly formed lid; in FIGS. 2*a* to 2*c* the end 22 of the card blank 12 which forms the lower portion of the front wall of the pack is shown angled upwards for convenience, but its position at the first station is such as to allow the pusher rod to engage the inner frame 16. As the inner frame 16 is pushed by the pusher rod, the upper region of the lateral portions of the front wall of the inner frame 16 slide under the inner lid flap formed by the folding of the card blank 12 by the first lever, enter the opposed recesses therein and become wedged between the holding tabs of the inner lid flap and the lid front wall. Once the inner frame 16 has been moved by the pusher rod from its initial position relative to the bundle 14 and blank 12, shown in FIG. 2*a*, to its desired position relative thereto in the final hinge-lid pack, shown in FIG. 2*c*, the pusher rod retracts. Preferably, the longitudinal distance between the initial and final positions of the inner frame 16 on the bundle 14 of cigarettes is between about 8 mm and about 15 mm, more preferably about 10 mm.

Figure 2D:
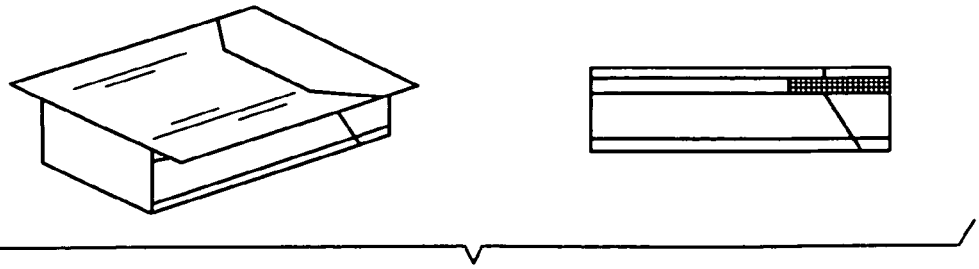

The bundle 14 of cigarettes and the inner frame 16 are transferred by further rotation of the folding wheel 10 to the second folding station 24, where the second lever folds the other end 22 of the card blank 12 over the opposite end of the bundle 14 and the inner frame 16 to form the lower portion of the front wall of the pack as shown in FIG. 2*d*. The folding of the blank 12 around the bundle 14 of cigarettes and the inner frame 16 to form the hinge-lid pack is then completed at subsequent folding stations downstream of the second folding station 24 with the retention means in correct engagement.

By moving the inner frame relative to the cigarettes and the blank during production, the apparatus of the invention shown in FIGS. 1 and 2 ensures that the "lid-lock" is actuated in the final hinge-lid pack and so functions correctly when the pack is first opened and closed by the consumer.

The apparatus and method of the present invention have been exemplified above with reference to the production of a hinge-lid cigarette pack from a blank and inner frame of the type disclosed in EP-A-0 434 962 and WO-A-02/02306. It will be appreciated that embodiments of the apparatus and method of the invention may be used to produce hinge-lid cigarette packs from other blanks and inner frames.

Where the means for moving the inner frame comprises an angled guide rail or bar, the inner frame may advantageously be modified to include a "turned up" end, distant from the end of the blank forming the lid of the pack, so as to facilitate engagement of the inner frame by the rail or bar. In the embodiment of the apparatus of the invention described above, folding of the card blank around the bundle of cigarettes and inner frame is carried out on an indexing wheel mounted for rotation about a horizontal axis. Known apparatus for producing hinge-lid packs in which folding of the laminar blank around the wrapped bundle of cigarettes and inner frame to form the pack is completed on an indexing wrapping wheel mounted for rotation about a vertical axis, such as packers sold by Focke & Co. (GmbH & Co.) of Verden, Germany, may also be modified to include means for moving the inner frame relative to the the blank during pack production.

The invention claimed is:

1. A method for making a hinge-lid pack of cigarettes comprising:

positioning an inner frame on a bundle of cigarettes;

folding a first end of a blank for a hinge-lid cigarette pack over one end of the bundle of cigarettes to at least partially form the lid of the pack;

moving the inner frame relative to the blank in the direction of the at least partially formed lid; and bringing retention means provided on the blank and the inner frame into cooperation by moving the inner frame relative to the blank in the direction of the at least partially formed lid.

2. A method according to claim 1, further comprising folding a second end of the blank over the other end of the bundle of cigarettes to at least partially form a lower portion of the front wall of the pack.

3. A method according to claim 1 comprising:

sliding an upper region of a lateral portion or the front wall of the inner frame under an inner lid flap formed by folding the first end of the blank over the bundle; and wedging the upper region of the lateral portion of the inner frame between the front wall of the at least partially formed lid and a holding tab defined by a recess in the inner lip flap.

4. A method according to claim 1, wherein the method comprises making a hinge-lid pack having rounded or beveled vertical edges.

* * * * *